US009208673B2

(12) United States Patent
Grignan et al.

(10) Patent No.: US 9,208,673 B2
(45) Date of Patent: Dec. 8, 2015

(54) MONITORING SYSTEM, MONITORING MODULE APPARATUS AND METHOD OF MONITORING A VOLUME

(75) Inventors: Patrick Grignan, Beausoleil (FR); Alberto Baldacci, Forte dei Marmi (IT); Johannes Pinl, Monaco (MC); Douglas Boit, Monaco (MC); Marco Cappelletti, Rosignano Marittimo (IT)

(73) Assignee: Blueburg Overseas SA, Panama City (PA)

( * ) Notice: Subject to any disclaimer, the term of this patent is extended or adjusted under 35 U.S.C. 154(b) by 486 days.

(21) Appl. No.: 13/567,364

(22) Filed: Aug. 6, 2012

(65) Prior Publication Data

US 2013/0169809 A1 Jul. 4, 2013

(30) Foreign Application Priority Data

Aug. 5, 2011 (GB) ..... 1113540.7

(51) Int. Cl.

| | |
|---|---|
| ***G08B 23/00*** | (2006.01) |
| ***G08B 21/08*** | (2006.01) |
| ***B63C 9/00*** | (2006.01) |
| *G08B 13/24* | (2006.01) |

(52) U.S. Cl.

CPC ..... *G08B 21/08* (2013.01); *B63C 9/0005* (2013.01); *G08B 13/2494* (2013.01); *G08B 21/086* (2013.01)

(58) Field of Classification Search

CPC .. B63C 9/0005; G08B 13/2494; G08B 21/08; G08B 21/086

USPC ..... 340/984, 539.1, 539.11, 539.13, 573.1, 340/539.26, 573.6, 568.1

See application file for complete search history.

(56) References Cited

U.S. PATENT DOCUMENTS

| | | | | |
|---|---|---|---|---|
| 6,348,942 | B1 * | 2/2002 | Watkins | 348/81 |
| 2006/0098088 | A1 * | 5/2006 | Raghunath | 348/61 |
| 2009/0096867 | A1 * | 4/2009 | Skjelten et al. | 348/113 |

(Continued)

FOREIGN PATENT DOCUMENTS

| | | | |
|---|---|---|---|
| EP | 1849703 | * | 10/2007 |
| EP | 1849703 | A2 | 10/2007 |

(Continued)

OTHER PUBLICATIONS

UK Search Report for GB Application No. 1113540.7, dated Oct. 24, 2011.

*Primary Examiner* — Daniel Previl

(74) *Attorney, Agent, or Firm* — Bracewell & Giuliani LLP

(57) ABSTRACT

A monitoring system for a periphery of a structure (100) comprises a monitoring module (102) having a detection and ranging system (304, 308) arranged to support monitoring of a portion of the periphery in order to detect passage of a body beyond the periphery. The detector (304, 308) has an imaging resolution that prevents conclusive visual identification by a human operator of the nature of the body. The monitoring module also comprises a video capture apparatus (312, 314) arranged to provide video data. The system also comprises a monitoring station apparatus (200) arranged to receive data from the monitoring module (102). In response to detection of the passage of the body by the detection system (304, 308), the monitoring station (200) enables the operator to review the video data. The video data enables the operator to identify readily the nature of the body detected and thereby to provide confirmatory visual evidence when the body is human.

25 Claims, 9 Drawing Sheets

(56) References Cited

U.S. PATENT DOCUMENTS

| | | | | |
|---|---|---|---|---|
| 2011/0279673 | A1* | 11/2011 | Teich et al. | 348/148 |
| 2012/0320219 | A1* | 12/2012 | David et al. | 348/169 |

FOREIGN PATENT DOCUMENTS

| | | |
|---|---|---|
| FR | 2948436 | 1/2011 |
| JP | 60025880 | 2/1985 |

* cited by examiner

MONITORING SYSTEM, MONITORING MODULE APPARATUS AND METHOD OF MONITORING A VOLUME

FIELD OF THE INVENTION

The present invention relates to a monitoring system of the type that, for example, monitors an exterior of a structure, such as a vessel, in order to detect a passage of a body, such as when a man overboard event occurs. The present invention also relates to a monitoring module apparatus of the type that, for example, is attached to a structure for monitoring an exterior of the structure for passage of a body, such as when a man overboard event occurs with respect to a vessel. The present invention further relates to a method of monitoring a volume enveloping a structure, for example a vessel, the method being of the type that, for example monitors a portion of the volume in order to detect a passage of a body, such as when a man overboard event occurs.

BACKGROUND OF THE INVENTION

Marine vessels are commonly used modes of transport for transporting cargos and passengers over bodies of water of varying distances. To this end, it is known to transport cargos and/or passengers using different types of vessel suited to the types of cargo or passenger to be transported, for example cruise ships, cargo vessels, oil tankers, and ferry boats. However, on occasions passengers on these vessels can accidentally fall overboard and in some unfortunate cases intentionally jump overboard. Such events are known as "man overboard" events.

When a person is overboard, the typical way of detecting the occurrence of such an event is by way of witnesses. However, witnesses are not always present to see the man overboard event. This can particularly be the case at night.

When a man overboard event occurs, the vessel has to turn back and try to search for and rescue the person in the water. This search and attempted rescue procedure typically has an associated financial cost as well as a time cost. These costs are particularly acute when hours or even days have to be expended before finding the person overboard. Additionally, the longer a search continues the less likely the passenger is to be found alive. Further, the time taken to detect the man overboard event accurately can impact upon the duration of the search and rescue procedure.

A number of man overboard detection systems exist. However, many such systems require passengers to wear a tag-like device, the absence of such a device from within a monitored volume surrounding the vessel being detectable by one or more monitoring units. When a man overboard event occurs, a person wearing the device enters the water but the vessel typically continues travelling, resulting in a distance between the device and the vessel developing. In such circumstances, the device rapidly falls out of range of the monitoring units aboard the vessel and so one of the monitoring units initiates an alert to the crew of the vessel indicative of the occurrence of a man overboard event. In some systems, the devices worn by passengers are configured to detect immersion in water in order to ensure the alert is triggered with minimal delay.

While such systems are useful, they have a core requirement that the tags need to be worn by passengers. Unfortunately, the tags can be removed, either accidentally or intentionally by passengers, thereby reducing the reliability of the man overboard detection system. Furthermore, tag-based systems are not typically designed to enhance safety aboard cruise ships or ferry boats; the systems are usually used aboard smaller vessels carrying a small number of passengers where a high probability of a man overboard event occurring exists, for example aboard racing yachts.

It is therefore desirable to achieve detection of man overboard events without the use of tags that need to be worn. In this respect, detection of a fall or jump from a vessel without the use of tags is complex. The detection system needs to operate in real time, because timely detection of man overboard events is very important to increasing the probability of saving lives, especially in cold water. Performance of the detection system needs to be high: an almost 100% detection rate of man overboard events is desirable, whilst the occurrence of false alarms needs to be extremely low in order to avoid execution of unnecessary search and rescue procedures.

BRIEF SUMMARY OF THE INVENTION

According to a first aspect of the invention, there is provided a monitoring system for a periphery of a structure, the system comprising: a monitoring module comprising: a detection system arranged to support monitoring of a portion of the periphery corresponding to a coverage field in order to detect, when in use, passage of a body beyond the periphery, the detection system having an imaging resolution that prevents conclusive visual identification by a human operator of the nature of the body; a video capture apparatus arranged to provide video data in respect of the overage field; and a monitoring station apparatus arranged to receive data from the monitoring module and in response to detection of the passage of the body by the detection system to enable review of the video data by the human operator, the video data enabling the human operator to identify readily the nature of the body detected and thereby to provide confirmatory visual evidence when the body is human.

The detection system may be arranged to support monitoring of a portion of a volume with respect to the structure in order to detect, when in use, passage of the body across at least part of the portion of the volume.

The volume may envelop the vessel.

The filtered or unfiltered output data may be filtered using a second filter. The second filter may be a kinematic filter. This may identify all the target trajectories of interest and remove all the target trajectories that cannot be associated with the passage of a human body.

The monitoring module may comprise a local processing resource arranged to support detection of the passage of the body and to communicate detection of the passage of the body to the monitoring station apparatus.

The video capture apparatus and the local processing resource may be arranged to cooperate in order to store the video data and to communicate the video data to the monitoring station apparatus in response to detection of the passage of the body by the detection system.

The video data may be buffered and may relate to a period of time in respect of the passage of the body across the at least part of the portion of the volume.

The video capture apparatus may be arranged to buffer captured video; the video may be stored as the video data.

The system may further comprise a buffer; the buffer may be arranged to store video data in respect of a most recent predetermined time window.

The system may further comprise: a wired or wireless communications network arranged to support communications between the monitoring module and the monitoring station apparatus.

The monitoring module may further comprise a wireless communications module. The local processing resource may use the wireless communications module to communicate the buffered video data and/or body trajectory data to the monitoring station apparatus over the wireless communications network.

The system may further comprise: a signal processing module arranged to analyse data generated by the detection system in order to detect the passage of the body across the at least part of the portion of the volume.

The signal processing module may be arranged to detect a track pattern corresponding to the passage of the body.

The detection system may be a wireless object detector arranged to detect an echo from a transmitted probe signal.

The detection system may be arranged to measure range of the object over time.

The video imaging apparatus may comprise a camera. The camera may be an infrared camera.

The detection system may comprise a radar detector module.

The system may further comprise: a trajectory determination module arranged to analyse the passage of the body and to identify a location within the monitored volume from which the passage of the body started.

The location within the monitored volume may be a two-dimensional location.

The monitoring station apparatus may comprise the trajectory determination module. The trajectory determination module may be supported by a processing resource of the monitoring station apparatus.

The passage of the body across the at least part of the portion of the volume may be a falling body.

The passage of the body across the at least part of the portion of the volume may be a climbing body.

The monitoring station apparatus may be arranged to receive location data and to determine a location at which the passage of the body was detected.

The location may be expressed in terms of the infrastructure of the vessel, for example: ship side, ship sector, deck level and/or cabin number.

The location may correspond to GNSS coordinates.

The system may further comprise: a water current monitoring apparatus; wherein the monitoring station apparatus may be operably coupled to the water current monitoring apparatus and arranged to obtain an indication of a prevailing water current when the passage of the body was detected.

The monitoring station apparatus may be arranged to record a time at which the passage of the body is detected and/or the monitoring module may be arranged to record a time at which the passage of the body is detected.

The monitoring module may be arranged to generate an alert message in response to detection of the passage of the body.

The monitoring station apparatus may provide a video playback capability to review the video data at least in respect of the period of time in respect of the detection of the passage of the body.

The water current monitoring apparatus may comprise a high resolution radar and an automatic pan and/or tilt camera for tracking a floating body on the sea surface.

The camera may be arranged to follow the floating body in response to data generated by the radar. The vessel may comprise a safety device deployment apparatus for deploying a lifesaving ring in response to the alarm.

The vessel may comprise a marker deployment apparatus for deploying a fall position marker, for example a light and smoke buoy and/or an Emergency Position-Indicating Radio Beacon (EPIRB) in response to the alarm.

The video imaging capture may be trained on at least the portion of the volume to be monitored.

The detection system may be a wireless object detector.

The wireless object detector may be arranged to generate an electromagnetic beam or volume and to detect passage beyond the beam or at least into the volume.

The detection system may be a detection and ranging system.

The monitoring system may be for monitoring a volume enveloping the structure.

According to a second aspect of the present invention, there is provided a sea-faring vessel comprising the monitoring system as set forth above in relation to the first aspect of the invention.

The structure may be the vessel and the volume may envelop the vessel.

Compensation may be made for movement of the vessel in respect of the trajectory of the body.

The vessel may further comprise: a plurality of monitoring modules: and the plurality of monitoring modules may serve, when in use, to support monitoring of the periphery of the vessel.

When the detection system is the detection and ranging system, the plurality of monitoring modules serve, when in use, to support monitoring of the volume enveloping the vessel.

The plurality of monitoring modules may comprise the monitoring module.

According to a third aspect of the present invention, there is provided a method of monitoring a periphery of a structure, the method comprising: monitoring a portion of the periphery corresponding to a coverage field using a detection system in order to detect passage of a body beyond the periphery, the monitoring using an imaging resolution that prevents conclusive visual identification by a human operator of the nature of the body; capturing video as video data in respect of the coverage field; and in response to detection of the passage of the body as a result of the monitoring enabling review of the video data by the human operator, the video data enabling the human operator to visually identify readily the nature of the body detected and thereby to provide confirmatory visual evidence when the body is human.

According to a fourth aspect of the invention, there is provided a computer program code element arranged to execute the method as set forth above in relation to the third aspect of the invention. The computer program code element may be embodied on a computer readable medium.

According to a fifth aspect of the present invention, there is provided a monitoring module apparatus comprising: a detection system arranged to support monitoring of a portion of a periphery corresponding to a coverage field in order to detect, when in use, passage of a body beyond the periphery, the system having an imaging resolution that prevents conclusive visual identification by a human operator of the nature of the body; and a video capture apparatus arranged to provide video data in respect of the coverage field.

It is thus possible to provide a monitoring system, a monitoring module apparatus and a method of monitoring a volume that detects an alertable event without the need of devices that need to be worn by passengers. Continuous and unattended (at multiple locations) surveillance of the volume around a structure, for example a vessel, is achieved. The system, apparatus and method are also capable of fast and accurate response to the alertable event, for example a man overboard event. In this respect, the occurrence of false alarms is minimised. As the system, apparatus and method do not employ devices than need to be worn, the inability to detect the man overboard event as a result of accidental or intentional removal of the devices is obviated or at least mitigated. It is also possible to identify, with accuracy, the location on the structure (for example the vessel) where the alertable event was initiated, i.e. the fall or jump location, for example the ship side, the ship sector, the deck level and/or the cabin number. In the non-exclusive context of the vessel, this enables a passenger roll count to be focussed on an area of the vessel of interest, for example by checking whether the occupants of cabins of interest are truly missing or not.

The use of multiple monitoring modules in combination with a human verification serves to improve system performance, in particular minimisation of false alarms, whilst minimising the amount of manpower required to implement the system and method. Furthermore, the monitoring modules used are unobtrusive. The system, apparatus and method do not only find application on vessels that traverse the sea, and the system can be applied to other structures, for example floating or fixed platforms, such as hydrocarbon-extraction offshore platforms, buildings and/or bridges. Indeed, the system, apparatus and method can be applied to any environment where fall detection is required.

The system, apparatus and method provide a further advantage of being capable of detecting converse alertable events, namely attempts to climb the structure, for example the hull of a vessel, such as where the hull is climbed with illegal intent by pirates or terrorists. Consequently, not only do the system, apparatus and method serve to provide a safety facility, the system and method can also serve to provide a security facility.

BRIEF DESCRIPTION OF THE DRAWING

At least one embodiment of the invention will now be described, by way of example only, with reference to the accompanying drawings, in which:

FIG. 6(*b*) is a flow diagram of data processing steps of FIG. 6(*a*) in greater detail;

DETAILED DESCRIPTION OF THE INVENTION

Figure 1:
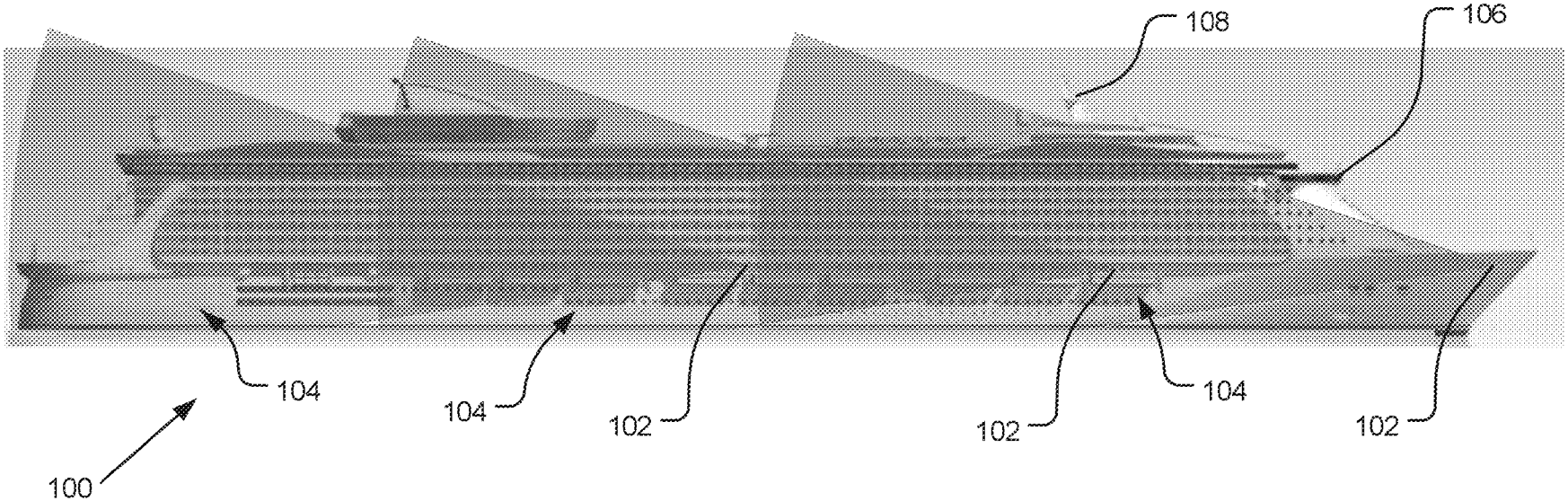
FIG. 1 is a schematic diagram of a vessel to be monitored by a monitoring system constituting an embodiment of the invention.

Throughout the following description identical reference numerals will be used to identify like parts.

Referring to FIG. 1, a passenger liner 100 is an example of a vessel, such as a sea-faring vessel, to be monitored for a so-called man overboard event. The vessel 100 is just one example of a structure that can be monitored. The vessel 100 can be of a type other than the passenger liner mentioned above. In this respect, the vessel 100 can be a ferry boat, or other kind of ship or platform, fixed or floating. As mentioned above, the structure need not be a vessel, for example the structure can be a building or a bridge. Indeed, the structure for the purposes of the examples described herein can be anything having an exterior that can be enveloped by a volume and it is desirous to monitor the volume to detect a body passing through at least part of the volume.

In this example, the vessel 100 is likewise enveloped by a volume that needs to be monitored in a manner to be described later herein. Consequently, the vessel 100 is equipped with monitoring modules 102 placed at strategic points about the vessel 100. Each monitoring module 102 has a respective coverage field or region 104 and, in this example, the monitoring modules 102 are arranged in order that the individual coverage volumes extend in order to monitor all portions of the volume enveloping the vessel 100 that require surveillance. It can therefore be seen that, in this example, the respective coverage fields are three dimensional. To provide comprehensive surveillance, it is therefore necessary to ensure that any part of the exterior of the vessel 100 across which a body can pass, in the event of accidentally or purposely falling from the vessel 100, is monitored. Furthermore, it is desirable to ensure that portions of the volume being monitored extend sufficiently far to ensure that it is possible to determine from where a passenger has possibly fallen. In this respect, this can be achieved by employing a greater number of monitoring modules or monitoring modules of greater range.

The monitoring modules 102 are capable of communicating with a monitoring station apparatus (not shown in FIGS. 1(*a*) and (*b*)). In this example, the monitoring station is located on the bridge 106 of the vessel 100. The vessel 100 is also equipped with a Global Navigation Satellite System (GNSS) receiver (not shown) coupled to a GNSS antenna 108 with which the vessel 100 is also equipped.

Figure 2:
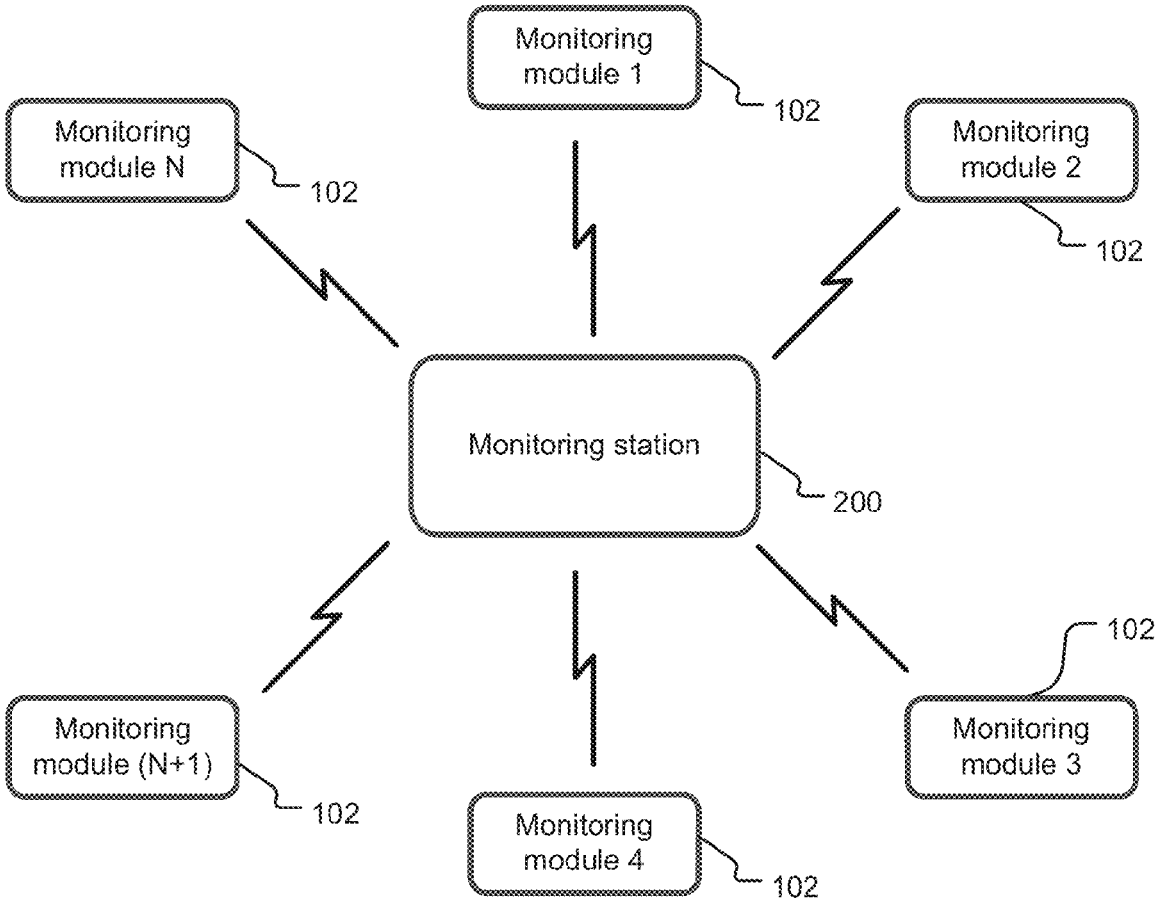
FIG. 2 is a schematic diagram of the monitoring system of FIG. 1.

Turning to FIG. 2, a wireless communications network is provided in order to support communications between the monitoring modules 102 and the monitoring station 200. Of course, if feasible and desirable, the communications network can be wired or a combination of wired and wireless communication technologies.

In one embodiment, which is an example of centralised processing, information collected by the monitoring modules 102 is transmitted, to the monitoring station 200 for central processing by the monitoring station 200. In the present embodiment employing distributed processing, data processing is performed by the monitoring module 102, resulting in alarm messages being transmitted to the monitoring station 200. The actual processing architecture employed depends on a number of factors. However, distributed processing ensures that the monitoring station 200 is not burdened with an excessive amount of processing and minimises the risk of network traffic saturation. Additionally, if certain processing functions described later herein relating to detection of a falling body are performed centrally by the monitoring station 200, as opposed to being performed by individual monitoring modules 102, a central failure of the monitoring station 200 will result in a complete failure of the monitoring system instead of a partial failure confined to failure of a particular monitoring module 102. The failure does not therefore result in a failure to monitor all portions of the volume of the vessel 100 being monitored. Additionally, although for some installations a centralised approach may reduce overall system costs, simplify software maintenance and upgrading, and increase overall system reliability, some ships or yachts do not have room to support a central processing architecture, which would typically include a server rack.

Figure 3:
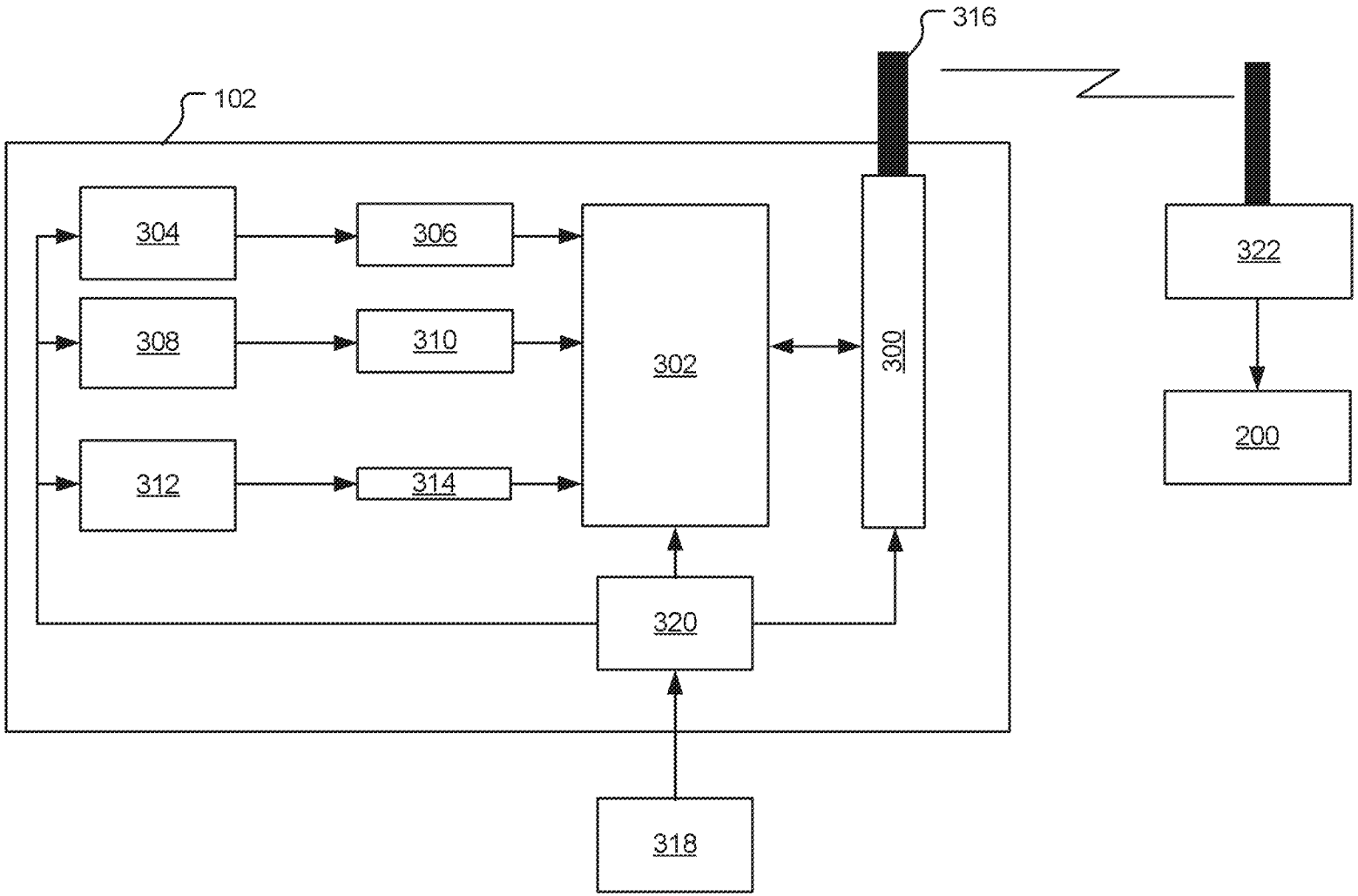
FIG. 3 is a schematic diagram of a monitoring module of the system of FIG. 2 in greater detail and constituting another embodiment of the invention.

Referring to FIG. 3, the monitoring module 102 comprises a data communication module 300, for example a Local Area Network (LAN) switch, provided in order to support communication between a local processing resource, for example a local processor 302, and the monitoring station 200. A first detection module 304 is coupled to the processing resource 302 by way of a first appropriate interface unit 306. Similarly, a second detection module 308 is coupled to the processing resource 302 by way of a second appropriate interface unit 310. Of course, whilst in this example reference is made to the first and second detection modules 304, 308, the skilled person should appreciate that a greater or fewer number of detection modules can be employed. In this example, the first and second detection modules 304, 308 are automotive forward-looking radars, for example the ARS 309 model of automotive radar available from A.D.C. GmbH (a subsidiary of Continental Corporation). In another embodiment, the detection modules can be microwave barriers, such as the ERMO series of microwave barriers available from CIAS Elettronica Srl. Returning to the present example, the first and second interface units 306 and 310 are coupled to the processing resource 302 via suitable Universal Serial Bus (USB) ports of the processing resource 302. In this example, the first and second detection modules 304, 308 therefore send collected data over a Controller Area Network (CAN) and so the first and second interface units 306, 310 are CAN-to-USB interface units. The first and second detection modules 304, 308 can alternatively be connected to the rest of the system hardware by means of other interfaces, for example a LAN interface or a standard serial interface. In another embodiment, the first and second detection modules 304, 308 can be arranged to output data via their own USB, LAN or serial interface by default. In such circumstances, the first and second interface units 306, 310 are not required.

An infrared camera 312, having in this example a frame rate of 25 Hz is coupled to a video server unit 314 via a coaxial cable. The camera 312 and the video acquisition or server unit 314 constitute a video capture apparatus that provides video data on the processing resource 302. In this example, the camera 312 is a thermal imaging camera for example a TAU320 IR camera core available from FUR systems, which detects temperature differences and is therefore capable of working in total absence of light. However, any other suitable camera can be used. Indeed, the skilled person should appreciate that other camera types can be employed, for example when it is not necessary to monitor the vessel 100 in poor light conditions, such as at night. The video acquisition unit 314 is any suitable video processing unit, for example a suitably configured PC video card or a USB video capture device, capable of capturing video from image data communicated by the infrared camera 312. In the event that the video acquisition unit 314 is a USB video capture device, the video capture device is coupled to the processing resource 302 via another suitable USB port of the processing resource 302. In this example, the camera is positioned so that the field of view of the camera 312 is trained on a region that includes the fields of view of the first and second detection modules 304, 308. Of course, if only a single radar module is employed, the camera 312 is trained on a region that includes the field of view of the single radar module.

The first radar module 304 and the second radar module 308 can be coupled to the first and second radar-to-USB interface units 306, 310 using a communications standard other than the CAN standard. However, the CAN standard is convenient, because in this example the first and second radar modules 304, 308 are automotive forward-looking radars having CAN standard interfaces.

A power supply unit 318 is coupled to a low-voltage power supply unit 320, the low voltage power supply unit 320 being coupled to the first radar modules 304, the second radar module 308, the infrared camera 312 and the local processor 302 in order to supply these entities with power.

The data communications module 300 is also arranged to support wireless communications over the wireless communications network. To this end, the data communications module 300 comprises an antenna 316 for wireless communications and is appropriately configured. In this example, the wireless communications network operates in accordance with one of the "wifi" standards, for example IEEE 802.11b, g or n. Consequently, the data communications module 300 is configured to support one or more of these wifi standards.

The data communications module 300 is capable of communicating with a wireless communications gateway 322 located, in this example, on or near the bridge 106 of the vessel 100. The antenna 316 can therefore be either omnidirectional or directional, depending on the module installation point with respect to the wireless communications gateway 322. The wireless communications gateway 322 is coupled to the monitoring station 200. Depending on mount position of the monitoring modules 102, the monitoring modules 102 can communicate with the wireless communications gateway 322 that can be located at a convenient location on the vessel 100. The wireless communications gateway 322 can then be connected either by wire or wirelessly to the monitoring station 200.

In one implementation, the interface units 306, 310, 314, the data communications module 300 and the local processor 302 can be integrated onto a common circuit board.

Figure 4:
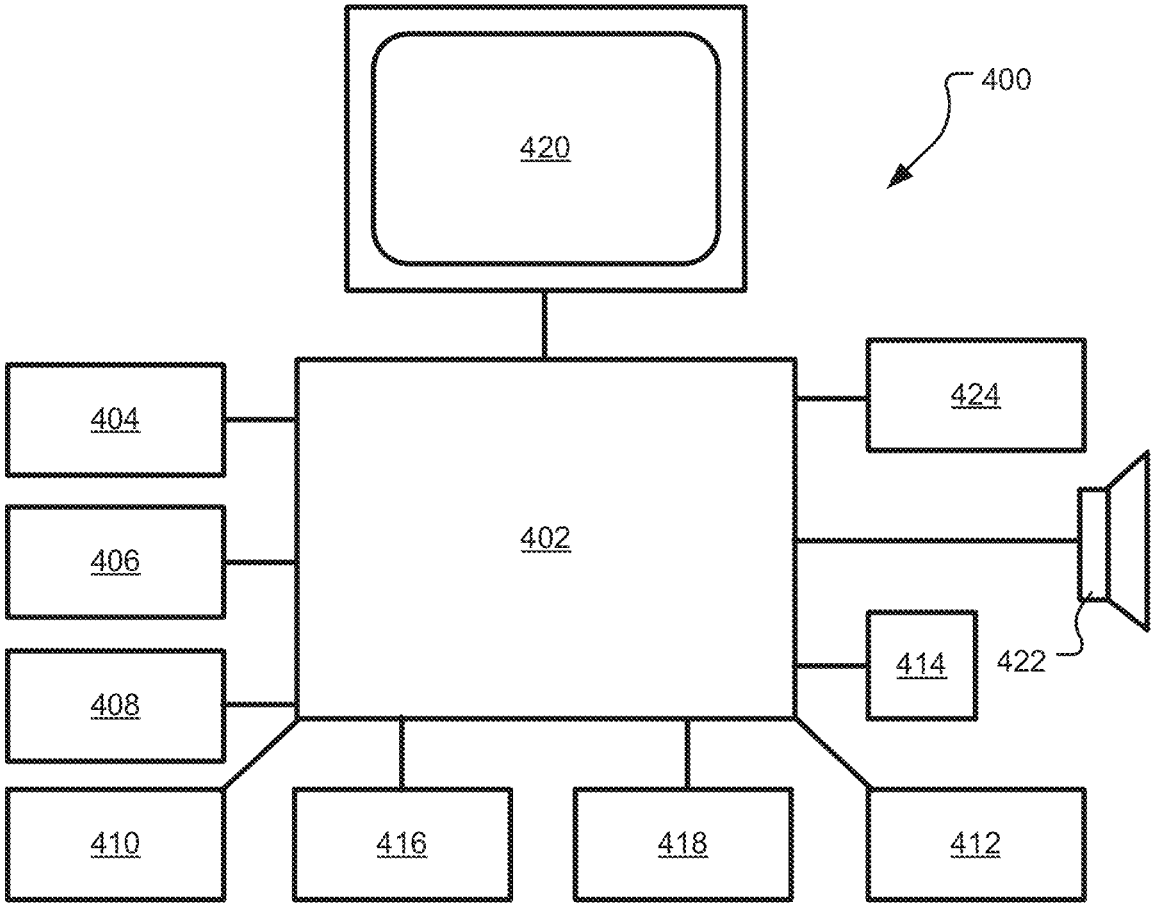
FIG. 4 is a schematic diagram of a monitoring station of the system of FIG. 2 in greater detail.

Referring to FIG. 4, the monitoring station 200 is, in this example, supported by a computing apparatus 400, for example a suitably configured Personal Computer (PC). In overview, the computing apparatus 400 comprises a processing resource 402, for example a processor, such as a microprocessor.

The processor 402 is coupled to a plurality of storage devices, including a hard disc drive 404, a Read Only Memory (ROM) 406, a digital memory, for example a flash memory 408, and a Random Access Memory (RAM) 410.

The processor 402 is also coupled to one or more input devices for inputting instructions and data by a human operator, for example a keyboard 412 and a mouse 414.

A removable media unit 416 coupled to the processor 402 is provided. The removable media unit 416 is arranged to read data from and possibly write data to a removable data carrier or removable storage medium, for example a Compact Disc-ReWritable (CD-RW) disc.

The processor 402 can be coupled to a Global Navigation Satellite System (GNSS) receiver 418 for receiving location data, either directly or via the LAN. Similarly, the processor 402 can be coupled to a navigation information system of the vessel 100 for receiving attitude information (yaw, tilt, roll) concerning the vessel 100. A display 420, for instance, a monitor, such as an LCD (Liquid Crystal Display) monitor, or any other suitable type of display is also coupled to the processor 402. The processor 402 is also coupled to a loudspeaker 422 for delivery of audible alerts. Furthermore, the processor 402 is also able to access the wireless communications network by virtue of being coupled to the wireless communications gateway 322 via either a wireless communications interface 424 or indirectly by wire.

The removable storage medium mentioned above can comprise a computer program product in the form of data and/or instructions arranged to provide the monitoring station 200 with the capacity to operate in a manner to be described later herein. However, such a computer program product may, alternatively, be downloaded via the wireless communications network or any other network connection or portable storage medium.

The processing resource 402 can be implemented as a standalone system, or as a plurality of parallel operating processors each arranged to carry out sub-tasks of a larger computer program, or as one or more main processors with several sub-processors.

Although the computing apparatus 400 of FIG. 4 has been referred to as a Personal Computer in this example, the computing apparatus 400 can be any suitable computing apparatus, for example: a Tablet PC or other slate device, a workstation, a minicomputer or a mainframe computer. The computing apparatus 400 can also include different bus configurations, networking platforms, and/or multi-processor platforms. Also, a variety of suitable operating systems is available for use, including UNIX, Solaris, Linux, Windows or Macintosh OS.

Figure 5:
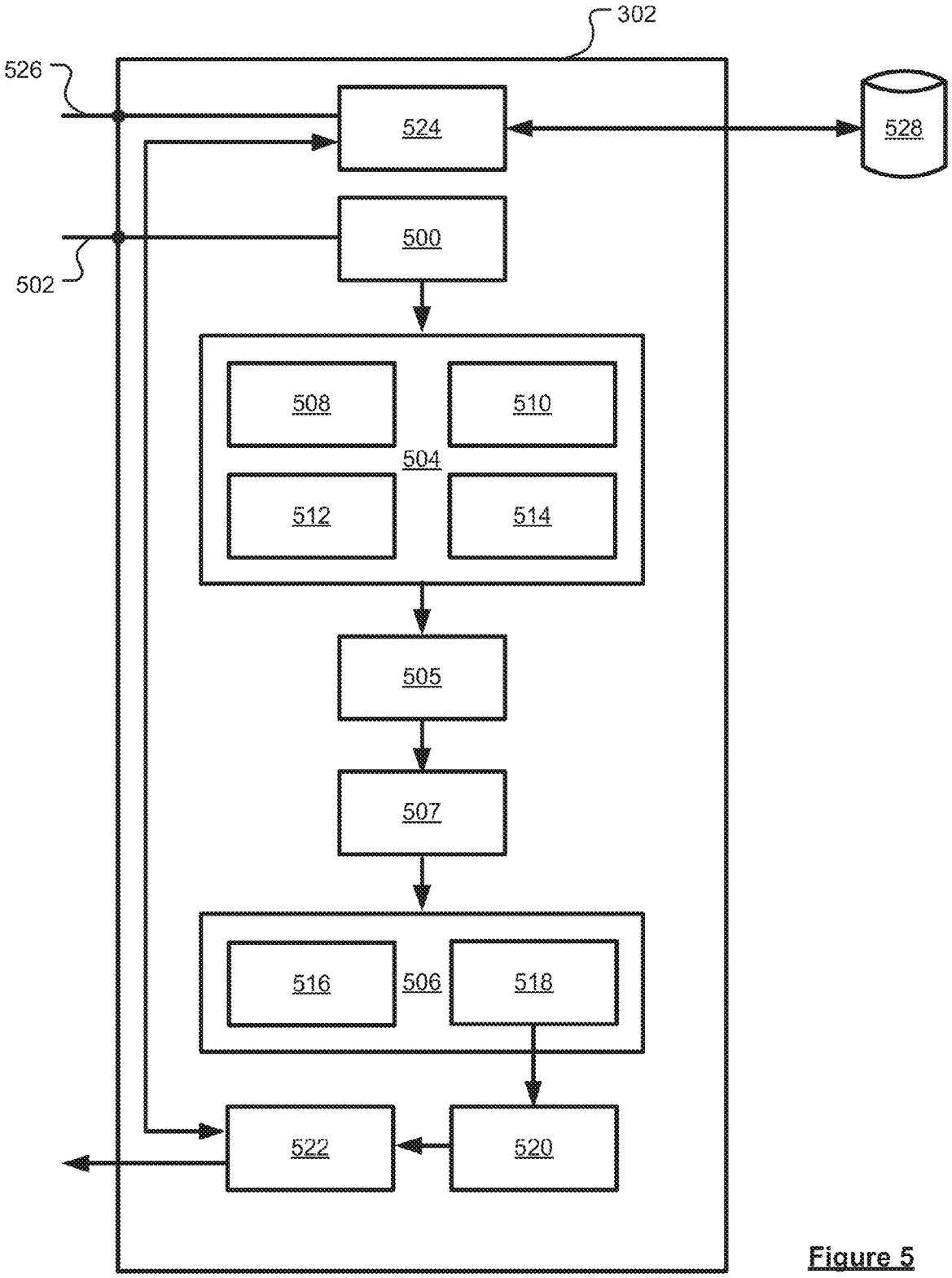
FIG. 5 is a schematic diagram of a local processing resource of the monitoring module of FIG. 3 in greater detail.

Turning to FIG. 5, a data pre-selection unit 500 supported by the processing resource 402 is operably coupled to a data acquisition input 502. A pre-filter unit 504 and a kinematic filter unit 506 are also operably coupled in a cascading manner with the data pre-selection unit 500. In this example, the pre-filter unit 504 comprises a minimum track duration filter 508, a minimum track extent (or span) filter 510, an artefact removal filter 512 and a geometric filter 514. The kinematic filter unit 506 comprises an average speed of fall filter 516 and a cumulative speed of fall filter 518. The kinematic filter 506 is also operably coupled to an alert generation module 520 supported by the processing resource 402 and a data output 522. The alert generation module 520 is also operably coupled to a video feed processing unit 524, the video feed processing unit 524 being operably coupled to a video input 526 and a circular video buffer 528.

Figure 6A:
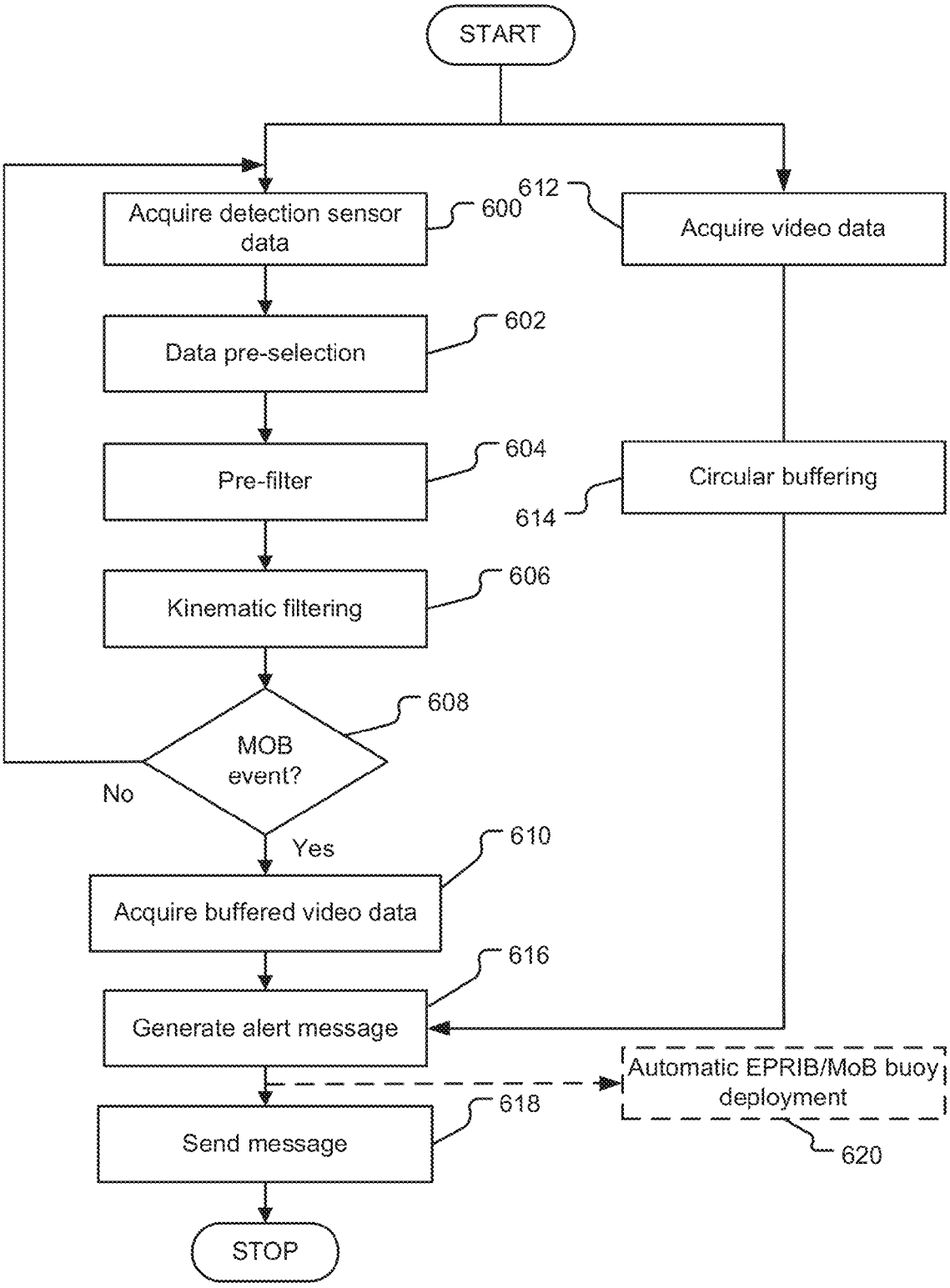
FIG. 6(*a*) is a flow diagram of a method of monitoring of a volume enveloping a periphery of a structure, the method constituting a further embodiment of the invention.
Figure 6B:
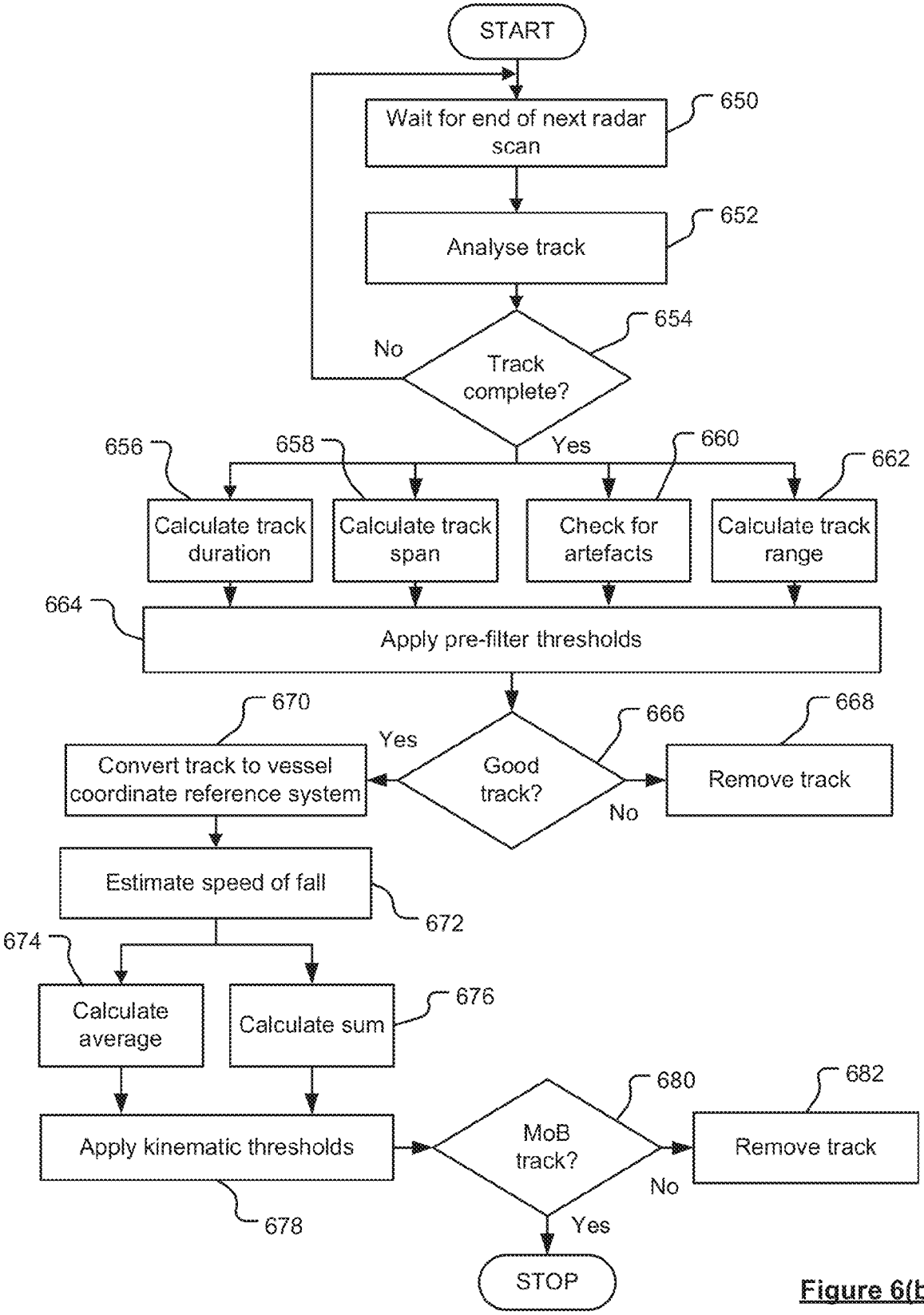

In operation (FIG. 6 (*a*)), the monitoring modules 102 each monitor their respective regions and behave in a like manner. Consequently, for the sake of conciseness and clarity of description, operation of one of the monitoring modules 102 and interaction thereof with the monitoring station 200 will only be described herein. However, the skilled person should appreciate that the other monitoring modules operate in a like manner.

As described above, processing of information collected by the detection modules 304, 308 is performed by the monitoring module 102. This processing relates to the detection of a man overboard event and generating an alert in response to the detection of the man overboard event.

In this respect, when a man overboard event occurs, the monitoring module 102 has to detect the falling body. The monitoring module 102 monitors a portion of the volume that needs to be monitored. When the body falls from the vessel 100, the body passes across at least part of the portion of the volume being monitored by the monitoring module 102. The first and second radar modules 304, 308 serve to monitor the at least part of the portion of the volume being monitored (hereinafter referred to as the "monitored volume portion") in order to detect passage of a body across the at least part of the monitored volume portion. The first and second radar modules 304, 308 are examples of wireless object detectors arranged to detect an echo from a transmitted probe signal. In this respect, the first and second radar modules 304, 308 constitute detection and ranging sensors and are useful due to their superior detection performance as compared with captured video analysed by image processing software. In this respect, detection of objects using video data requires additional processing that is not required by detection and ranging sensors such as radars. Additionally, detection and ranging sensors do not require light in the visible range of the electromagnetic spectrum and so can operate in poor ambient light conditions or the complete absence of light. Furthermore, detection and ranging sensors do not require light in the invisible range of the electromagnetic spectrum, where video camera performance is suboptimal in certain meteorological conditions, such as rain or fog. Indeed, radar coordinates used enable detection of objects to within a sub-meter accuracy, thereby enabling the track of a falling body to be reconstructed with high accuracy. However, the visual imaging resolution of the first and second radar modules 304, 308 is such that if the data generated by the first and second radar modules 304, 308 were to be visually displayed, a human operator would not be able to identify visually the nature of the body conclusively as human. Indeed, angular or spatial resolution limitations and detection clustering techniques of the first and second radar modules 304, 308 is such that the data acquired from the first and second radar, if displayed graphically, appear as so-called "points", "blobs" or "blips", typical of radar. Consequently, it is not possible to determine whether one or more reflections detected by a radar of the spatial resolution described herein, when presented, relate to a human body, a non-human object being dropped, or something else. Although, in this example, a pair of radar modules is employed, the skilled person should appreciate that the monitoring module 102 can comprise a greater or smaller number of radar modules.

Additionally or alternatively, detection sensors other than of the detection and ranging sensor type can be used, such as microwave barriers. In this respect, an alarm can be generated when a body impinges upon or crosses the volume between a transmitter and a receiver, in a similar manner to tripwires. However, the skilled person will appreciate that the trajectory of the falling object is not estimated when such virtual tripwire type devices are used. The tripwire type sensors can be used, as an example, to monitor the stern of the vessel 100.

In another embodiment, as mentioned above, instead of using detection and range sensors, the vessel 100 can be monitored by tripwire type sensors disposed about the periphery of the vessel 100 and on all levels. In examples employing the tripwire type sensor(s), the tripwire type sensor(s) can be microwave sensors capable of generating an ellipsoidal beam between a transmitter and a receiver, the diameter of the beam being, in this example, greater towards the centre of the beam than at distal ends thereof. Consequently, the tripwire type sensors can effectively monitor a volume in order to provide a binary output to indicate when the beam has been crossed.

The first and second radar modules 304, 308 generate (Step 600) radar data by scanning a volume, in this example, 15 times per second in order to detect fixed and moving objects with a location accuracy of a few centimeters. The radar data generated is communicated via the first and second CAN-to-USB interfaces 306, 310 to the local processor 302. The data generated by the first and second radar modules 304, 308 is received via the data acquisition input 502 and analysed by the data pre-selection unit 500. The data pre-selection unit 500 removes (Step 602) extraneous data generated by the first and second radar modules 304, 308 and provided amongst the radar data communicated to the local processor 302. In this respect, extraneous data is data not used by the following processing steps, for example periodic messages sent by the radar containing diagnostics information.

The radar modules 304, 308 each comprise a so-called radar "tracker" that generate "tracks" by associating in time and space detections assumed to correspond to the same target. In doing so, the radar tracker initiates a new track whenever an association of sequential detections is possible, as well as updating existing tracks as new detections that can be associated to the respective existing tracks become available. The radar tracker also terminates tracks when no more detections can be associated with a given track. The association criteria can depend on the particular tracker in use, but typically tracking decisions are made based upon target position and speed criteria. In this example, the data pre-selection unit 500 serves to extract the tracks from amongst other data generated by the radar modules 304, 308.

Thereafter, the raw radar data, i.e. the tracks, is subjected to the pre-filter unit 504 in order to undergo a number of filtering processes to remove tracks that are not of interest (Step 604).

The pre-filter unit 504 processes tracks that have been terminated, namely the tracks that are no longer in the process of being constructed by the radar tracker. To this end, the pre-filter unit 504 supports a complete track identification process that "loops over" each available track to determine whether the track is complete or terminated. In this respect, the pre-filter unit 504 waits until the end of a radar scan session (Step 650) and then analyses (Step 652) each available track in order identify (Step 654) the tracks that have been terminated. When a terminated track is not identified, the above process (Steps 650, 652, 654) is repeated until a completed track has been identified, whereupon the completed track is subjected to, in this example, at least four pre-filters, the minimum track duration filter 508, the minimum track extent (or span) filter 510, the artefact removal filter 512 and the geometric filter 514. These filters attempt to remove all the tracks generated by the radar tracker that are very unlikely to be associated with a falling object. The minimum track duration filter 508 removes tracks that are too short in time, for example comprising too few measurement points. Such tracks are very short in duration and are usually associated with random signal fluctuations that are interpreted by the radar as real tracks. The minimum track extent filter 510 removes tracks that are spatially too short (a falling object is expected to generate a sufficiently long track, and therefore tracks that are spatially too short are usually associated with non-moving objects, such as radar scatter from the hull of the vessel 100). The artefact removal filter 512 removes radar artefacts, i.e. occasional detections not associated with real objects but generated by the detection modules 304, 308 by mistake. Finally, the geometric filter 514 removes tracks that reside outside a preset surveillance area for example tracks that reside beyond a predetermined maximum range, because detection of man overboard events for larger ranges is not sufficiently reliable. The data that survives these filters constitutes a data set comprising persistent tracks associated with non-stationary targets and is free of tracks that result from reflections from some unwanted or irrelevant objects and other sources, for example the hull of the vessel 100, rain and general signal noise. Consequently, the minimum track duration filter 508 calculates (Steps 656) the duration of each track being analysed, the minimum track extent filter 510 calculates (Step 658) the "span" of each track being analysed. The artefact removal filter 512 determines (Step 660) what artefacts, if any, exist in the tracks being analysed and the geometric filter 514 calculates (Step 662) the range of each track being analysed. Once the above calculations have been performed each respective filter 508, 510, 512, 514 applies (Step 664) respective predetermined thresholds associated therewith in order to perform a discrimination operation. If a given track survives the above pre-filters, the track is deemed (Step 666) a suitable track to undergo further analysis, because the track relates to potential man overboard event. However, if the track does not survive any of the above mentioned pre-filters, the failing track is removed (Step 668) from further analysis.

Figure 7:
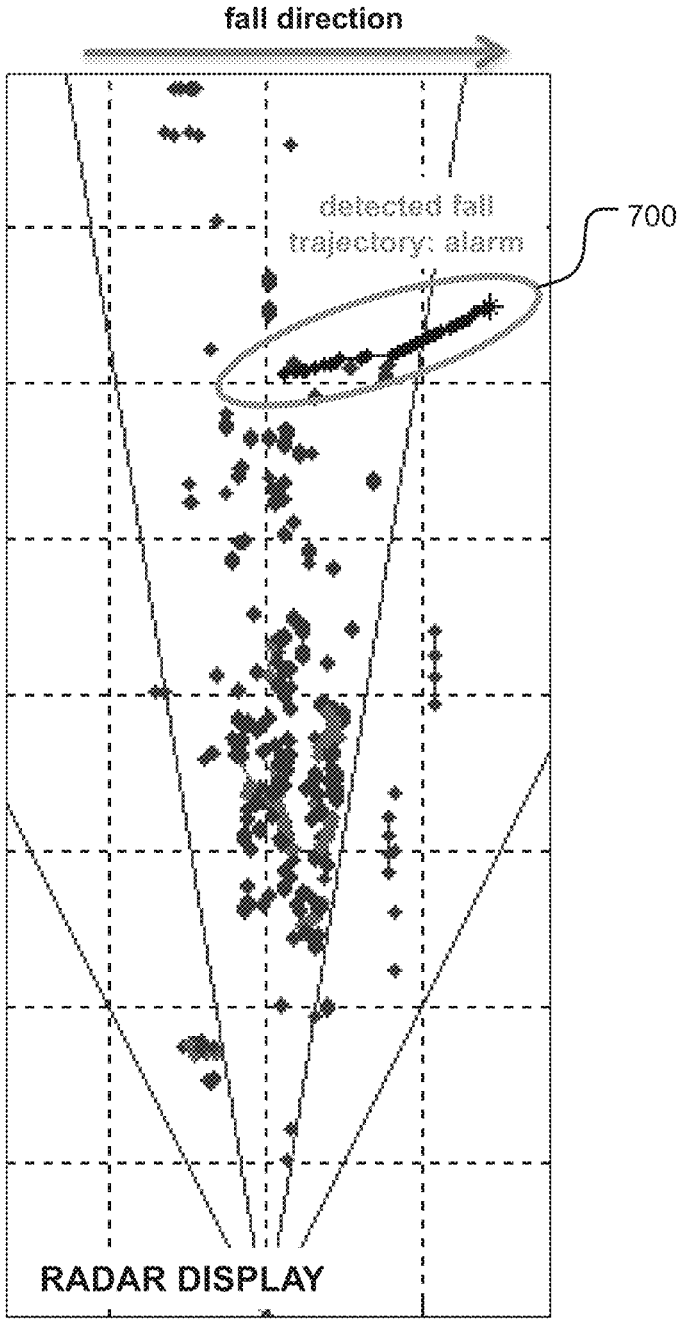
FIG. 7 is a schematic "visualisation", as a radar plot, of output data generated by the monitoring module of FIG. 3.
Figure 8:
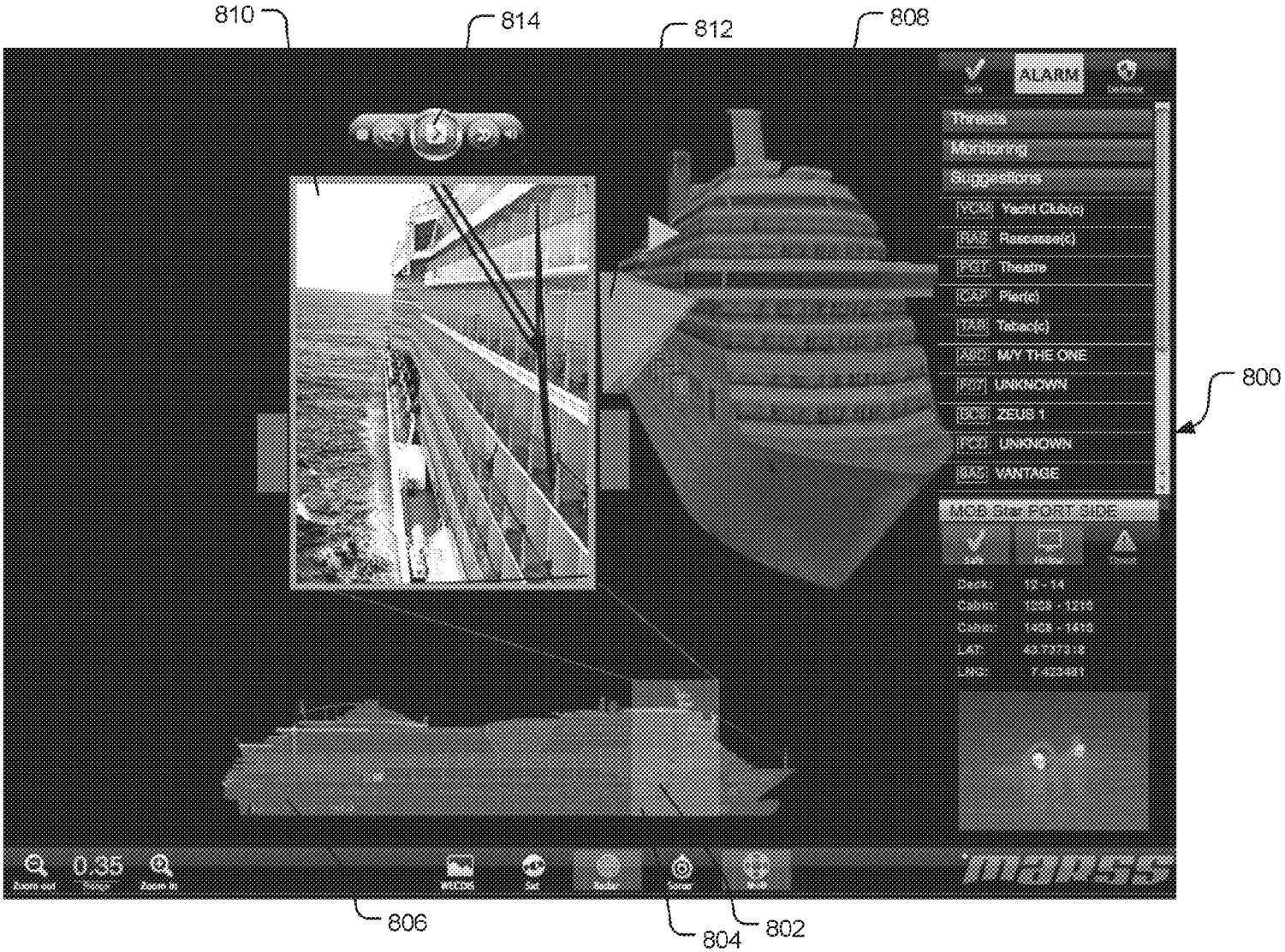
FIG. 8 is a schematic diagram of a monitoring console window supported by the monitoring station of FIG. 4.

Thereafter, the surviving tracks (FIG. 7) are converted by the coordinate converter 505 to the coordinates of the coordinate reference system of the vessel 100 (Step 670). Once in the new reference system the converted surviving tracks are then passed to the fall estimator 507 and the fall estimator 507 estimates the speed of fall (Step 672) of the target. By converting the surviving tracks to the coordinate frame of the vessel 100, the attitude (yaw, pitch, roll) of the vessel 100 can be used in order to compensate for movement of the vessel 100.

Following calculation by the fall estimator 507, the estimated speed of fall of the target is then analysed by the kinematic filter unit 506 and filtered (Step 606). The kinematic filter unit 506 is used to identify tracks likely to represent a falling body, i.e. objects moving at high speed from the top to the bottom of the vessel 100. The average velocity of fall filter 516 of kinematic filter unit 506 therefore calculates (Step 674) the average velocity, $v_f$, of the target and the cumulative velocity of fall filter 518 calculates (Step 676) the sum of the velocities of measurement points of a track. A minimum fall speed threshold value is then applied to the average velocity calculated (Step 678) in order to filter out tracks not possessing a predetermined, for example high, average velocity of fall as these are indicative of a falling body, for example bodies travelling at velocities greater than 2 $ms^{-1}$. However, detection sensitivity can be modified by varying this velocity parameter. Similarly, a minimum speed sum threshold is applied (Step 678) against the sum of velocities calculated in order to filter out non-qualifying velocity sums. Only tracks 700 surviving both filters are deemed to represent potential man over board events. By virtue of this kinematic filtering tracks corresponding to other flying objects, for example birds, are removed.

Tracks that are deemed not to correspond to man overboard events (Step 680) are removed from the dataset of candidate tracks (Step 682). In such circumstances, the search for man overboard events continues by analysing subsequent track data.

During receipt and processing of the radar-related data, the video feed processing unit 532 receives (Step 612) video data corresponding to a video that has been captured by the video server unit 314 at the same time as the radar data was generated by the first and second radar modules 304, 308. The video data generated is communicated to the local processing resource 302 via the video acquisition unit 314. Upon receipt of the video data via the video input 526, the video feed processing unit 524 buffers (Step 614) the video data in the circular video buffer 528. The video data is buffered so as to maintain a record of video corresponding to elapse of a most recent predetermined period of time. In this respect, the predetermined period of time is a rolling time window and includes the time frame of the radar data being processed. Hence, the most recent n seconds of video is stored. Of course, if greater storage capacity is available all video from a journey can be stored for subsequent review. In an alternative embodiment, the video acquisition unit 314 can manage the buffering of video data.

In the event that a potential man over board track 700 is detected (Step 608), the detection is communicated to the alert generation module 522. The alert generation module 522 then obtains (Step 610) the buffered video data relating to the time period that includes the time the man overboard event was detected from video buffer 536 via the video feed processing unit 532.

Once obtained, the alert generation module 522 generates (Step 616) an alert message that includes the radar data and the video data corresponding to the period of time in which the man overboard event is detected to have occurred. If desired, the alert message can include time data, for example a timestamp, relating to the time the man overboard event was detected. In this example, the alert message also includes the coordinates of the track trajectory (body trajectory data) in the reference coordinate system of the vessel 100, so that the track can be plotted on top of a representation of the vessel 100 for immediate visual communication of fall position, as will be described in further detail later herein.

The alert message is then communicated (Step 618) to the monitoring station 200 using the wireless communications functionality of the data communications module 300 so that the alert message is communicated via the wireless communication network. Alternatively, if available, a wired communication network can be used for alarm message transmission from the monitoring module 102 to the monitoring station 200.

At the monitoring station 200, the computing apparatus 400 supports an alert monitoring application. Upon receipt of the alert message from the monitoring module 102, the alert monitoring application analyses the message in order to extract the radar data and the video data communicated by the monitoring module 102. Thereafter, the alert monitoring application generates, in this example, both an audible alert via the loudspeaker 422 and a visual alert to a human operator via a monitoring console window 800 displayed by the display 420. In the monitoring console window 800, the alert monitoring application displays the radar trace derived from the radar data in a radar display pane 802 in the manner already described above. The fall trajectory originally provided by the first radar modules 304 or the second radar module 308, now represented in the reference system of the vessel 100, allows the identification of the location from which passage of the body started, i.e. the location from which the body has fallen, and this information is then displayed in a fall trajectory pane 804. In this example, the calculated trajectory is displayed, in this example in two dimensions, against an image 806 of the vessel 100 so that the human operator can determine the location of the vessel 100 from where the body has fallen, such as a deck sector, deck level, room number and/or balcony.

The alert monitoring application also presents a three dimensional image 808 arranged to show more detail of the part of the vessel 100 from where the body is detected to have fallen. Accompanying the three dimensional image 808 is a video playback pane 810 and a marker 812 showing the location of the monitoring module 102 to which video associated with the video playback pane 810 relates and, in this example, the field of view of the monitoring module 102. The video pane 810 has control buttons 814 so that the human operator can control payback of the video data included with the alert message sent by the monitoring module 102.

Consequently, the video playback facility enables the human operator to review the video recorded at the time of the detection of the potential man overboard event. In this respect, the video data enables the human operator to identify readily the nature of the falling body detected. The video data therefore serves as confirmatory visual evidence so that the human operator can confirm whether or not the falling body is human. If desired, in order to further assist the human operator, a track estimated by the monitoring module 102 can be superimposed on the video played so that the movement of the body can be more readily identified without delay.

In the event that the human operator confirms that the body detected as falling is human, the operator can formally raise an alarm aboard the vessel 100 and a search and rescue operation can commence. In the event that the falling body is not human, a false alarm situation is avoided.

In another embodiment, the monitoring station 200 can be operably coupled to a marker deployment apparatus for deploying (Step 620) a marker or buoy to identify a fall position, for example a light and/or smoke buoy and/or an Emergency Position-Indicating Radio Beacon (EPRIB) in response to confirmation of the man overboard event.

In yet another embodiment, GNSS data can be obtained from the GNSS receiver mentioned above and the location of the vessel 100 at the time the body fell from the vessel 102 can be recorded and provided to aid rescue efforts. The coordinates are, in this example, GNSS coordinates, for example Global Positioning Satellite (GPS) coordinates. Additionally or alternatively, if the vessel 100 is equipped with a surface current measurement system to monitor the water current around the vessel 100, prevailing water current information can be recorded in respect of the time the body is detected as falling from the vessel 100 and so this information can be provided to aid the search and rescue effort. Additionally or alternatively, the floating body can be tracked with a high-resolution radar which can be also used to steer a motorised infrared camera. It is thus possible to keep constant visual contact with the drifting body.

As will be appreciated by the skilled person, the examples described herein relate to the detection of the man overboard event. Such alertable events relate to the detection of a falling body. However, the skilled person should appreciate that the system, apparatus and method described herein can be applied to converse directions of movement in order to detect a body climbing the hull of the vessel, for example in cases of piracy and/or hijacking. In such circumstances, the kinematic filter unit 506 can be tuned to recognise movements in the converse direction, for example climbing movements.

In the examples described herein, the monitoring modules at least serve to collect data from the monitoring sensors. The data needs to be processed in order to detect a falling body. In this example, data processing is also carried out by the monitoring module 102. However, data processing can be either centralised, or distributed, or a hybrid processing implementation which is a combination of the centralised and distributed techniques (for example, radar data can be processed in the sensor modules 304, 308 and video buffering can be performed monitoring station 200, or vice versa). In the embodiments herein, collected data is processed directly by the monitoring module 102 and only alarm messages are transmitted to the monitoring station 200 for visualisation and raising an alarm. In a centralised approach, raw data is communicated to the monitoring station 200 for processing in order to detect a falling body as well as visualisation and raising an alarm.

Consequently, the skilled person should appreciate that some of or all the functions described herein could be performed in the processing unit 302 of the monitoring module 102. Similarly, some of the functions described herein can be performed in the monitoring station 200 rather than in the monitoring modules 102, depending on the processing architecture (distributed, hybrid, centralised; in which case the local processing resource of FIG. 5 would not necessarily be employed).

What is claimed is:

1. A monitoring system for a periphery of a structure, the system comprising:

a monitoring module comprising:

a detection system arranged to support monitoring of a portion of the periphery corresponding to a coverage field in order to detect, when in use, passage of a body beyond the periphery, the detection system having an imaging resolution that prevents conclusive visual identification by a human operator of the nature of the body;

a video capture apparatus arranged to provide video data in respect of the coverage field; and a monitoring station apparatus arranged to receive data from the monitoring module and in response to detection of the passage of the body by the detection system to enable review of the video data by the human operator, the video data enabling the human operator to identify readily the nature of the body detected in order to provide confirmatory visual evidence when the body is human.

2. The system according to claim 1, wherein the detection system is arranged to support monitoring of a portion of a volume with respect to the structure in order to detect, when in use, passage of the body across at least part of the portion of the volume.

3. The system according to claim 2, wherein the volume envelops the vessel.

4. The system according to claim 1, wherein the monitoring module comprises a local processing resource arranged to support detection of the passage of the body and to communicate detection of the passage of the body to the monitoring station apparatus.

5. The system according to claim 4, wherein the video capture apparatus and the local processing resource are arranged to cooperate in order to store the video data and to communicate the video data to the monitoring station apparatus in response to detection of the passage of the body by the detection system.

6. The system according to claim 1, wherein the video data is buffered and relates to a period of time in respect of the passage of the body across the at least part of the portion of the volume.

7. The system according to claim 6, when dependent upon claim 5, wherein the video capture apparatus is arranged to buffer captured video, the video being stored as the video data.

8. The system according to claim 1, further comprising:

a wired or wireless communications network arranged to support communications between the monitoring module and the monitoring station apparatus.

9. The system according to claim 1, further comprising:

a signal processing module arranged to analyse data generated by the detection system in order to detect the passage of the body across the at least part of the portion of the volume.

10. The system according to claim 9, wherein the signal processing module is arranged to detect a track pattern corresponding to the passage of the body.

11. The system according to claim 1, wherein the detection system is a wireless object detector arranged to detect an echo from a transmitted probe signal.

12. The system according to claim 1, wherein the detection system comprises a radar detector module.

13. The system according to claim 1, further comprising:

a trajectory determination module arranged to analyse the passage of the body and to identify a location within the monitored volume from which the passage of the body started.

14. The system according to claim 1, wherein the passage of the body across the at least part of the portion of the volume is a falling body.

15. The system according to claim 1, wherein the passage of the body across the at least part of the portion of the volume is a climbing body.

16. The system according to claim 1, wherein the monitoring station apparatus is arranged to receive location data and to determine a location at which the passage of the body was detected.

17. The system according to claim 1, further comprising:

a water current monitoring apparatus; wherein the monitoring station apparatus is operably coupled to the water current monitoring apparatus and arranged to obtain an indication of a prevailing water current when the passage of the body was detected.

18. The system according to claim 1, wherein the monitoring station apparatus is arranged to record a time at which the passage of the body is detected and/or the monitoring module is arranged to record a time at which the passage of the body is detected.

19. The system according to claim 1, wherein the monitoring module is arranged to generate an alert message in response to detection of the passage of the body.

20. The system according to claim 1, wherein the monitoring station apparatus provides a video playback capability to review the video data at least in respect of the period of time in respect of the detection of the passage of the body.

21. The system according to claim 1, wherein the detection system is a wireless object detector.

22. The system according to claim 1, wherein the detection system is a detection and ranging system.

23. A sea-faring vessel comprising the monitoring system according to claim 1.

24. The vessel according to claim 23, further comprising:

a plurality of monitoring modules; and the plurality of monitoring modules serving, when in use, to support monitoring of the periphery of the vessel.

25. A method of monitoring a periphery of a structure, the method comprising:

monitoring a portion of the periphery correspond to a coverage field using a detection system in order to detect passage of a body beyond the periphery, the monitoring using an imaging resolution that prevents conclusive visual identification by a human operator of the nature of the body;

capturing video as video data in respect of the coverage field; and in response to detection of the passage of the body as a result of the monitoring enabling review of the video data by the human operator, the video data enabling the human operator to visually identify readily the nature of the body detected in order to provide confirmatory visual evidence when the body is human.

* * * * *